US007764907B2

(12) United States Patent
Ino

(10) Patent No.: US 7,764,907 B2
(45) Date of Patent: Jul. 27, 2010

(54) CHARGING APPARATUS AND IMAGE FORMING APPARATUS

(75) Inventor: Toshiaki Ino, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 712 days.

(21) Appl. No.: 11/604,299

(22) Filed: Nov. 27, 2006

(65) Prior Publication Data

US 2007/0122195 A1 May 31, 2007

(30) Foreign Application Priority Data

Nov. 25, 2005 (JP) ..... P2005-341082

(51) Int. Cl.
*G03G 15/02* (2006.01)

(52) U.S. Cl. ..... 399/170; 399/171; 399/173

(58) Field of Classification Search ..... 399/170, 399/171, 173

See application file for complete search history.

(56) References Cited

U.S. PATENT DOCUMENTS

| | | | | |
|---|---|---|---|---|
| 5,257,073 | A | 10/1993 | Gross et al. | |
| 5,666,604 | A * | 9/1997 | Nakagami et al. | 399/171 |
| 6,025,594 | A * | 2/2000 | Bryce et al. | 250/324 |
| 2005/0117944 | A1 | 6/2005 | Kawada et al. | |
| 2007/0019982 | A1 | 1/2007 | Kawada et al. | |
| 2007/0122196 | A1 | 5/2007 | Ino | |

FOREIGN PATENT DOCUMENTS

| | | | |
|---|---|---|---|
| HR | 1621956 | | 6/2005 |
| JP | 61-98368 | | 5/1986 |
| JP | 61-209461 | A | 9/1986 |
| JP | 61231573 | A * | 10/1986 |
| JP | 63-270439 | A | 11/1988 |
| JP | 8-203661 | A | 8/1996 |
| JP | 9-80869 | | 3/1997 |
| JP | 11-40316 | | 2/1999 |
| JP | 2000-58225 | A | 2/2000 |
| JP | 2001-166569 | | 6/2001 |
| JP | 2003107785 | A * | 4/2003 |
| JP | 2004-4334 | | 1/2004 |
| JP | 2004-245948 | A | 9/2004 |
| JP | 2005-99670 | | 4/2005 |

OTHER PUBLICATIONS

U.S. Office Action mailed Oct. 17, 2008 in co-pending U.S. Appl. No. 11/604,300.

U.S. Appl. No. 11/226,327, filed Sep. 15, 2005, inventors: Deguchi et al.

* cited by examiner

*Primary Examiner*—David M Gray
*Assistant Examiner*—Erika Villaluna
(74) *Attorney, Agent, or Firm*—Nixon & Vanderhye P.C.

(57) ABSTRACT

There is provided a charging apparatus having high durability, in which no rusts etc. are generated, and by which a potential of a photoreceptor drum being charged can be controlled stably within an appropriate range for a long period of time owing to hardly impaired controllability of the potential of the photoreceptor drum being charged even with a some amount of contaminants such as toner that may be deposited on, and which is inexpensive as well. A charging apparatus includes a needle electrode, a holding member, two cleaner members, a support member, a moving member, a shield case, and a platy grid. On the surface of the needle electrode is formed a nickel layer containing tungsten.

7 Claims, 3 Drawing Sheets

CHARGING APPARATUS AND IMAGE FORMING APPARATUS

BACKGROUND OF THE INVENTION

1. Field of the Invention

The present invention relates to a charging apparatus and an image forming apparatus.

2. Description of the Related Art

In electrophotographic image forming apparatuses such as copying machines, printers and facsimile units, images are formed as follows. By use of a photoreceptor drum on a surface of which a photosensitive layer containing a photoconductive substance is formed as an image carrier, the surface of the photoreceptor drum is subjected to application of charges so as to be uniformly charged therewith. Subsequently, electrostatic latent images corresponding to image information are formed by various image forming processes. The electrostatic latent images are developed by a toner-containing developer supplied from a developing unit, so as to obtain visible images which are then transferred onto a recording material such as paper. After that, the visible images are fixed on the recording material by heat and pressure given by a fixing roller so that an image is formed on a recording paper.

In the image forming apparatus as described above, a charging apparatus is used for charging the surface of the photoreceptor drum. The charging apparatus is composed of: an electrode for conducting corona discharge on the photoreceptor drum; a grid which is optionally disposed between the surface of the photoreceptor drum and the electrode, for controlling an amount of charges imparted from the electrode to the surface of the photoreceptor drum, and thus controlling a potential of the surface of the photoreceptor drum being charged; a support member for supporting the electrode and the grid. Since the grid is capable of almost exactly controlling the potential of the surface of the photoreceptor drum being charged, a charging apparatus provided with the grid is becoming predominant at present. As the grid, for example, there are used a wire grid which is prepared from stainless steel or tungsten, and a porous plate grid which is formed of a metal plate (grid substrate) of stainless steel or the like with a large number of perforations.

As the electrode for the charging apparatus, for example, there are used a wire electrode and a metal plate electrode (hereinafter referred to as "needle electrode") having a plurality of needle portions. Among them, the needle electrode is preferably used because of its advantages such as a less number of components, a longer operating life, less generation amount of ozone, and less frequent failures by virtue of no disconnection. The needle electrode is manufactured by etching a metal plate which is mainly formed of an iron-based metal material such as stainless steel, to form a plurality of needle portions in the metal plate. The needle electrode manufactured by etching is also referred to as an etched electrode. An etched cross section of the needle electrode lacks in the smoothness. Further, a plurality of edges for conducting discharge are present at the top end of the needle portion, and the shape of the edges present at the top ends of a plurality of needle portions is not uniform. Accordingly, discharges from the respective needle portions are not uniform. As a result, it is not possible to sufficiently control the potential of the surface of the photoreceptor drum being charged, so that the potential of the charged surface of the photoreceptor drum becomes uneven.

Further, the material for the needle electrode, i.e. the iron-based metal material such as stainless steel has high durability, but involves a drawback of being easily oxidized due to water content under a high humidity circumstance and ozone generated by corona discharging during a charging operation. In addition, in a long-time use of the needle electrode, a use of the needle electrode under the high humidity circumstance, a contact of the needle electrode with ozone, etc. are inevitable. Accordingly, the needle electrode formed of a metal material such as stainless steel corrodes due to moisture in air or due to ozone etc., resulting in deterioration of durability thereof. In addition, there is lowered controlling performance for high voltage applied to the needle electrode for conducting the corona discharge from the needle portion, with the result that the potential of the discharged surface of the photoreceptor drum is uneven, leading a to-be-solved problem that the surface of the photoreceptor drum cannot be constantly charged to a desired potential in a stable manner.

Further, as in the case of the needle electrode, the wire electrode also involves a to-be-solved problem such that rust or corrosion occurs due to ozone generated by corona discharge, with the result that the potential of the charged surface of the photoreceptor drum is uneven.

In view of the foregoing problems in the charging apparatus, there has been proposed, for example, a charging apparatus including: a wire electrode extended in a shield case having one surface thereof open; and a plate grid arranged between the wire electrode and the photoreceptor drum, the plate grid which is formed by applying a nickel plated layer of about 1 μm thickness on a surface of a porous stainless steel plate and further forming thereon a gold plated layer of about 0.3 μm thickness (refer to, for example, Japanese Unexamined Patent Publication JP-A 11-40316 (1999)). In the plate grid of JP-A 11-40316, the gold plated layer is formed by way of the nickel plated layer, with the result that the gold plated layer is less easily peeled off, and the corrosion resistance and the controllability of the potential of the surface of the photoreceptor drum being charged are relatively satisfactory. However, the manufacture of the plate grid requires two plating steps, i.e., nickel plating and gold plating. This imposes drawbacks such as more complicated manufacturing step and increase of the cost. Further, in order to make this plate grid sufficiently exhibit the preferred characteristics as described above, a thickness of the gold metal layer needs to be set at 0.3 μm or more. In addition, since the plate grid is a relatively large member having a substantially the same size as the photoreceptor drum, the usage of gold is necessarily increased also because of the necessity for increasing the thickness of the plated layer. However, such a heavy usage of gold unnecessarily increases the cost of the charging apparatus and thus the cost of the image forming apparatus, resulting in loss of the general applicability of the image forming apparatus based on its relatively low price, which is one of the advantages of the image forming apparatus. Accordingly, there has been a demand for realizing, without using an expensive material such as gold, a charging apparatus having the needle electrode and the plate grid which are excellent in durability and controllability of the potential of the surface of the photoreceptor drum being charged.

Further, there has been proposed a charging apparatus including: a wire electrode; and a plate grid which is obtained by forming a gold plated layer directly on a surface of a stainless steel metal plate by an electrolytic plating method using a pulse current, as in the case of JP-A 11-40316 (refer to, for example, Japanese. Unexamined Patent Publication JP-A 2001-166569). Also in this plate grid electrode, the gold plated layer is less easily peeled off and, like the plate grid in JP-A 11-40316, the corrosion resistance is high and the controllability of the potential of the surface of the photoreceptor drum being charged are also favorable. However, also in this plate grid, a thickness of the gold metal layer needs to be set at 0.3 μm or more, it involves the same drawbacks as those in the charging apparatus of JP-A 11-40316.

Further, there has been a corona charging apparatus having a wire electrode, at least a shaft of which is formed of iron-tungsten-based amorphous metal (refer to, for example, Japanese Unexamined Patent Publication JP-A 61-98368 (1986)). There is an advantage that a use of the wire electrode of JP-A 61-98368 can decrease unevenness in charge on the surface of the photoreceptor drum. However, even such a wire electrode does not overcome the drawback of being easily oxidized due to ozone, to a sufficiently satisfactory level. Accordingly, in order to impart long-lasting durability to the wire electrode, a coating layer formed of metal or the like material must be formed on a surface of the shaft formed of iron-tungsten-based amorphous metal.

Further, in all of the charging apparatuses of JP-A 11-40136, JP-A 2001-166569, and JP-A 61-98368, in the case of forming images by use of toner which contains as an external additive silica having a surface thereof hydrophobized by trimethylsilyl group-containing-polysiloxanes (hereinafter referred to as "hydrophobic silica" unless particularly mentioned), the polysiloxanes are attached to the plate grid or the wire electrode. Due to the foregoing, the above charging apparatuses thus have drawbacks of easily causing charging defects. At present, the toner containing the hydrophobic silica is an essential constituent for speeding up image formations in an electrophotographic image forming apparatus.

On the other hand, it has also been proposed to coat the electrode with gold (refer to, for example, Japanese Unexamined Patent Publication JP-A 2004-4334). The charging apparatus of JP-A 2004-4334 includes a needle electrode on a surface of which a coating layer made of gold, platinum, copper, nickel or chromium is formed by plating. In JP-A 61-98368, a method of etching, precision pressing, or the like method is used for forming the needle electrode, but the cross section of the needle electrode obtained by the method lacks in smoothness and results in fine irregularities. Accordingly, even after applying the plating, fine irregularities on the cross section remain as they are and may disturb the balance of the corona discharge, resulting in uneven potential of the charged surface of the photoreceptor drum. Further, contaminants such as toner are easily deposited on the fine irregularities. That is, the needle electrode of JP-A 2004-4334 has a drawback that contaminants such as the toner are attached thereto during long time use and this causes the charged surface of the photoreceptor to have further uneven potential.

SUMMARY OF THE INVENTION

An object of the invention is to provide a charging apparatus having high durability, by which a potential of a photoreceptor drum being charged can be controlled stably within an appropriate range for a long period of time owing to hardly impaired controllability of the potential of the photoreceptor drum being charged even with a some amount of contaminants such as toner, particularly toner containing hydrophobic silica, that may be deposited on, and in which the deposited contaminants can be easily removed, and which is inexpensive, as well as an image forming apparatus including the charging apparatus, which is capable of recording images of high quality for a long period of time.

The invention provides a charging apparatus comprising:

an electrode having a plurality of pointed protrusions, that applies a voltage to a surface of a photoreceptor drum to charge the surface; and a platy grid disposed between the electrode and the photoreceptor drum, that controls a potential of the surface of the photoreceptor drum being charged, wherein a nickel layer containing tungsten is formed on at least one of surfaces of the electrode.

According to the invention, there is provided a charging apparatus comprising a platy needle-shaped electrode (hereinafter referred to as "a needle electrode") and a platy grid. The needle electrode has a plurality of pointed protrusions and applies a voltage to a surface of a photoreceptor drum. On a surface of the needle electrode is formed a nickel layer containing tungsten (hereinafter referred to as "a tungsten-containing nickel layer" unless particularly mentioned). The platy grid is disposed between the needle electrode and the photoreceptor drum, and controls a potential of the surface of the photoreceptor drum being charged. Owing to structural features such that the needle electrode has a plurality of pointed protrusions and a surface of the needle electrode is coated with the tungsten-containing nickel layer, corona dischargeability toward the surface of the photoreceptor drum is excellent, and the potential of the surface of the photoreceptor drum being charged can be controlled so as to fall within an appropriate range and so as to be uniform. Moreover, the needle electrode has high durability, and is capable of exerting the above-described charging controllability of potential in a stable manner over a long period of time. Furthermore, the needle electrode has a surface thereof coated with the tungsten-containing nickel layer whereby contaminants such as toner deposited on the surface can be easily removed by a commonly-used cleaning device. Accordingly, an image forming apparatus provided with a charging apparatus having the needle electrode is capable of recording images of high quality for a long period of time. Particularly in the case of forming images by use of toner containing hydrophobic silica as an external additive, the image forming apparatus exhibits excellent durability. Furthermore, the needle electrode is constructed by forming on a surface of a substrate not a gold plated layer which is used in the related art but a tungsten-containing nickel plated layer only, resulting in an advantage of lower cost compared to the needle electrode of the related art. The charging apparatus of the invention can be preferably used, owing to its excellent durability against ozone, particularly in a tandem type color image forming apparatus which generates a large amount of ozone when a plurality of charging apparatuses are driven at the same time.

Further, in the invention, it is preferable that the nickel layer containing tungsten is formed by an electroless plating method.

According to the invention, the tungsten-containing nickel layer is formed on the surface of the needle electrode by the electroless plating method. Compared to the tungsten-containing nickel layer obtained by a normal electrolytic plating method using DC electricity, the tungsten-containing nickel layer obtained by the electroless plating method has a dense and hard structure with less pinholes, of which layer thickness is thin and nevertheless uniform, and has high adhesion with the needle electrode substrate. Accordingly, the tungsten-containing nickel layer makes the rough surface of the needle electrode smooth so that the charging controllability of potential and durability of the needle electrode plate are further enhanced. Furthermore, the contaminants such as toner are less easily deposited on the needle electrode plate.

Further, in the invention, it is preferable that a thickness of the nickel layer containing tungsten is 0.3 μm or more.

According to the invention, a thickness of the tungsten-containing nickel layer in the needle electrode plate is set at 0.3 μm or more, with the result that the charging controllability of potential and durability of the needle electrode plate are securely exhibited.

Further, in the invention, it is preferable that another nickel layer is formed between the electrode and the nickel layer containing tungsten.

According to the invention, in the needle electrode, another nickel layer is formed between the electrode and the nickel layer containing tungsten, with the result that the tungsten-containing nickel layer is further prevented from being peeled off from the needle electrode substrate, resulting in enhancement in durability of the needle electrode. Accordingly, it is possible to obtain the charging apparatus which is capable of stably controlling the potential of the surface of the photoreceptor drum being charged over a longer period of time.

Further, in the invention, it is preferable that the nickel layer containing tungsten contains phosphorus together with tungsten.

According to the invention, in the needle electrode, the nickel layer containing tungsten contains phosphorus together with tungsten, with the result that the layer has enhanced adhesion with the needle electrode substrate and thus the needle electrode has further enhanced durability.

The invention provides an image forming apparatus comprising:

a photoreceptor drum on a surface of which an electrostatic latent image is formed;

one of the charging apparatuses described above, for charging the surface of the photoreceptor drum;

an exposure unit that irradiates the charged surface of the photoreceptor drum with signal light based on image information to thereby form the electrostatic latent image;

a developing apparatus that develops the electrostatic latent image formed on the surface of the photoreceptor drum to thereby form a toner image;

a transfer unit that transfers the toner image onto a recording material; and a fixing unit that fixes the toner image transferred on the recording material.

According to the invention, in the image forming apparatus composed of the photoreceptor drum, the charging apparatus, the exposure unit, the developing apparatus, the transfer unit, and the fixing unit, the use of the charging apparatus of the invention having the needle electrode on a surface of which the tungsten-containing nickel layer is formed, makes it possible to stably keep within an appropriate range the potential of the surface of the photoreceptor drum being charged during formation of the electrostatic latent images. Accordingly, images of high quality can be recorded over a long period of time and moreover, there is no gold plated layer which is contained in the related art, with the result that an inexpensive image forming apparatus can be obtained.

Further, in the invention, it is preferable that the image forming apparatus further comprises a cleaning unit that cleans the surface of the photoreceptor drum after the toner image has been transferred onto the recording material by the transfer unit, wherein the developing apparatus and/or the cleaning unit are/is located above the charging apparatus.

According to the invention, there is provided an image forming apparatus further comprising the cleaning unit for cleaning the surface of the photoreceptor drum, in which the developing apparatus and/or the cleaning unit are/is located above the charging apparatus. Particularly in the case of designing the tandem type color image forming apparatus, the constitution in which the developing apparatus and the cleaning unit are disposed above the charging apparatus, can contribute to more simplified constitution and reduced size of the image forming apparatus. This constitution has a drawback such that a charging defect is easily caused on the surface of the photoreceptor drum. However, in the image forming apparatus using the charging apparatus of the invention, even with the constitution that the developing apparatus and/or the cleaning unit are/is located above the charging apparatus, the generation of charging defect is remarkably suppressed so that images of high quality and high grade can be formed over a long period of time.

Further, in the invention, it is preferable that the toner image is formed of toner which contains hydrophobic silica as an external additive.

According to the invention, in the image forming apparatus of the invention, even when the toner containing hydrophobic silica as an external additive is used in order to speed up image formation, the charging defect attributable to deterioration of the charging apparatus is hardly caused, so that images of high quality and high grade can be formed over a long period of time.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
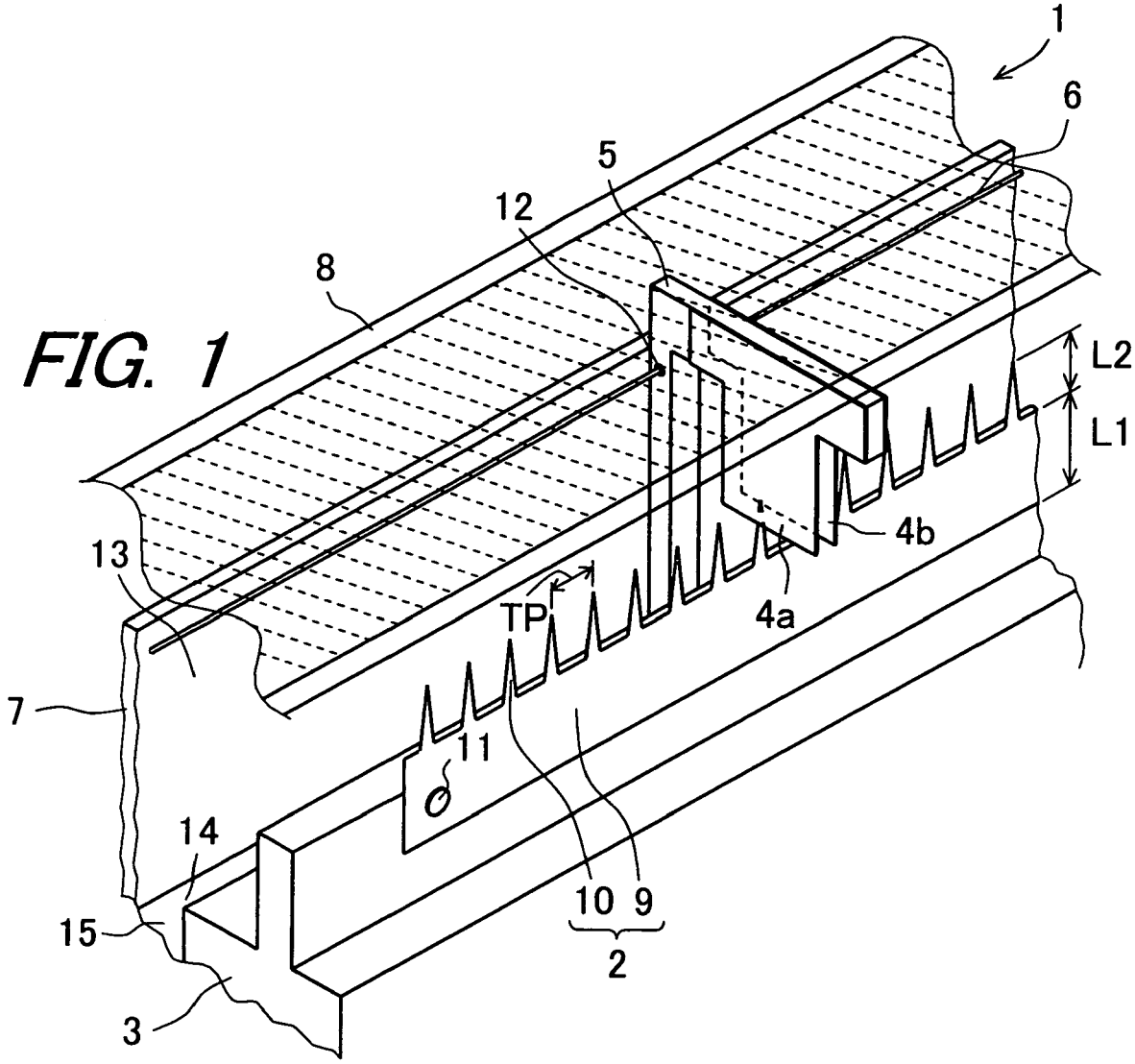
FIG. 1 is a perspective view schematically showing a configuration of a charging apparatus according to one embodiment of the invention.

Now referring to the drawings, preferred embodiments of the invention are described below.

Figure 2:
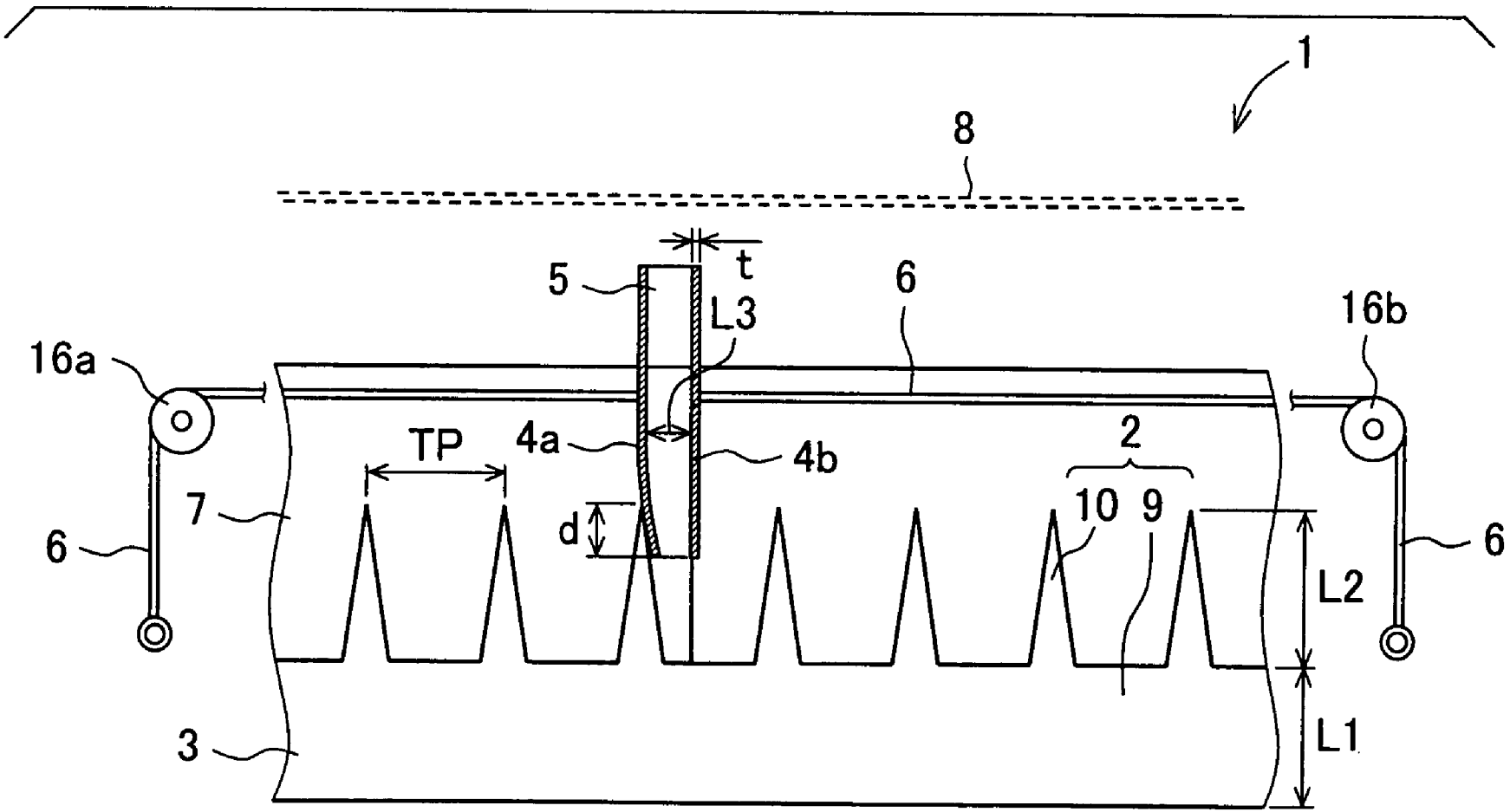
FIG. 2 is a front view of the charging apparatus shown in FIG. 1.

FIG. 1 is a perspective view schematically showing a configuration of a charging apparatus 1 according to one embodiment of the invention. FIG. 2 is a front view of the charging apparatus 1 shown in FIG. 1. The charging apparatus 1 includes a needle electrode 2, a holding member 3, two cleaner members 4*a* and 4*b*, a support member 5, a moving member 6, a shield case 7, and a platy grid 8. The needle electrode 2 is a platy member having a plurality of pointed protrusions 10. The holding member 3 holds the needle electrode 2. The cleaner members 4*a* and 4*b* are disposed so as to be movable relatively to the needle electrode 2, and clean a surface of the needle electrode 2 by frictionally rubbing the needle electrode 2 upon movement. The support member 5 supports the cleaner members 4*a* and 4*b*. The moving member 6 moves the cleaner members 4*a* and 4*b* and the support member 5. The shield case 7 contains the needle electrode 2, the holding member 3, the cleaner members 4*a* and 4*b*, and the support member 5. The platy grid 8 adjusts a potential of a surface of photoreceptor drum (not shown) being charged. The charging apparatus 1 is disposed along a longitudinal direction of the photoreceptor drum (not shown) so as to face the photoreceptor drum.

The needle electrode 2 is a thin plate member, for example, made of stainless steel, which is constituted by forming a tungsten-containing nickel layer over a surface of a needle electrode substrate composed of a flat plate 9 extending longitudinally in one direction and the pointed protrusions 10 formed so as to transversely protrude from one end face in a transverse direction of the flat plate 9. Referring, for example, to a size of the needle electrode 2, a length L1 in the transverse length of the flat plate 9 is preferably about 10 mm while a length L2 in the protruding direction of the protrusion 10 is preferably about 2 mm, a radius of curvature R at a top end of the protrusion 10 is preferably about 40 μm, and a pitch TP at which the protrusions 10 are formed is preferably about 2 mm.

The needle electrode 2 can be manufactured in accordance with a heretofore known method. One example of the method is a manufacturing method including a chemical polishing step, a water washing step, an acid dipping step, a water washing step, a pure water dipping step, a nickel layer forming step, a tungsten-containing nickel layer forming step, a water washing process, and a drying process. Among the steps, the nickel layer forming step is not an essential step, but optionally carried out. The nickel layer is formed, for example, by a general plating method.

In the chemical polishing step, masking and etching are performed so that a plurality of pointed protrusions are formed in a plate metal. The masking can be conducted in accordance with a heretofore known method. The etching can also be conducted in accordance with a heretofore known method, which includes, for example, a method of spraying an etching solution such as an aqueous solution of ferric chloride to the plate metal. As the metal for the material of the plate metal, any materials can be used without a particular restriction unless the material can conduct the corona discharge when a voltage is applied thereto, and can be subjected to formation of a pointed protrusion and plating. Examples of the material include, for example, stainless steel, aluminum, nickel, copper and iron. Among them, stainless steel is preferred. Specific examples of the stainless steel include, for example, SUS304, SUS309 and SUS316. Among them, SUS304 is preferred. A thickness of the plate metal is, without particular restriction, preferably from 0.05 to 1 mm and more preferably from 0.05 to 0.3 mm.

The plate metal in which the plurality of pointed protrusions are formed in the chemical polishing step, is treated with water washing, acid cleaning or pure water cleaning in the water washing step, the acid dipping step, the water washing step and the pure water dipping step, whereby obstacles are removed from the surface so that a needle electrode substrate is obtained.

In a tungsten-containing nickel layer forming step, the tungsten-containing nickel layer can be formed in accordance with an electroless nickel plating method including a catalytic nickel plating method (Kanigen process).

As a plating solution for forming the tungsten-containing nickel plated layer, heretofore known tungsten-nickel plating solutions can be used including, for example, a plating solution containing nickel salt, tungsten salt, a complexing agent, and a reducing agent. Examples of nickel salt includes nickel sulfate, nickel chloride, nickel acetate, and nickel carbonate. Examples of tungsten salt include sodium tungstate, potassium tungstate, and ammonium tungstate. Tungsten can be used also in a finely-powdered form. In such a case, a particle diameter of tungsten is preferably 1 μm or less and more preferably 100 to 500 nm. Examples of the complexing agent include citric acid, malic acid, and succinic acid. Examples of the reducing agent include hypophosphorous acid, sodium hypophosphite, potassium hydpophosphite, and nickel hypophosphite. Furthermore, a boron-containing compound can be added to the tungsten-nickel plating solution. Examples of the boron-containing compound include dimethylamine borane [$(CH_3)_2NHBH_3$], sodium borohydride ($NaBH_4$), dimethylamine boron, and diethylamine boron.

The tungsten-nickel plating solution is of about 3 to 11 pH. As the plating solution for use in the tungsten-nickel plating, those known among persons skilled in the art can be used including, for example, "NIWLOY 96" (trade name, manufactured by Asahi Precision Co., Ltd.). A tungsten-containing nickel plating layer formed by the "NIWLOY 96" contains 94% by weight nickel, 5% by weight tungsten, and 1% by weight boron.

The plating condition is also not particularly restricted. Depending on the kind of the plating solution, an appropriate temperature range may be selected from liquid temperatures ranging from, for example, around 60 to 95° C. and preferably around 80 to 95° C. Also regarding the plating method, a commonly-used method may be used. Typically, the to-be-treated needle electrode substrate is dipped in the plating solution until a plated membrane having an intended thickness is formed, and the electroless plating is conducted to thereby form the tungsten-containing nickel plated layer on the surface of the needle electrode substrate.

A content of tungsten in the tungsten-containing nickel plated layer is preferably 0.5 to 10% by weight and more preferably 3 to 7% by weight to an entire amount of the plated layer, and a remaining part thereof is formed of nickel. In the case where the tungsten-containing nickel plated layer contains phosphorus together with tungsten, a content of tungsten is the same as the content stated above while a content of phosphorus is preferably 1 to 14% by weight and more preferably 4 to 10% by weight to an entire amount of the layer, and a remaining part thereof is formed of nickel. Further, in the case where the tungsten-containing nickel plated layer contains boron together with tungsten, a content of tungsten is the same as the content stated above while a content of boron is preferably 0.1 to 5% by weight and more preferably 0.5 to 3% by weight to an entire amount of the layer, and a remaining part thereof is formed of nickel.

A layer thickness of the tungsten-containing nickel plated layer obtained at the tungsten-containing nickel plating step is, without a particularly restriction, preferably 0.3 μm or more and more preferably 0.3 to 20 μm and particularly preferably 4 to 20 μm and still more preferably 5 to 10 μm. Since the liquid agent of the plating solution is deposited uniformly on the surface of the needle electrode substrate, the tungsten-containing nickel plated layer formed by the electroless plating has a favorable characteristic that the layer is uniform with no variation in thickness and with the extremely small number of pinholes even in the case where the plating layer is as thin as about 0.3 μm. Further, the plating structure is dense and has high adhesion with the surface of the needle electrode substrate and even when used for a long time, no peeling or the like is caused.

In the case where the thickness is less than 0.3 μm, the pinholes are formed, resulting in uneven plated layer, and through the pinholes, stainless steel of the needle electrode substrate is easily corroded. As a result, the potential of the photoreceptor drum being charged may possibly become partially unstable, leading generation of the charging defects, or a deteriorated releasing property may possibly cause generation of attachment on tips of the needle electrode (sawtooth electrode), leading generation of the charging defects. On the other hand, if the thickness is much larger the 20 μm, the plated layer may possibly be peeled off by stress. Note that, as described above, the thickness of the plated layer is substantially in proportion with the plating time in the electroless plating and therefore, a plated layer of a desired thickness may be obtained by appropriately changing the dipping time of the needle electrode substrate into the plating solution.

The needle electrode (sawtooth electrode) produced by photoetching which is employed to give the tips sharpness, has an etched surface thereof rough, when observed by electron microscopy, with minute irregularities formed by the crystal grain boundary. The plated layer having a thickness of 4 to 20 μm has a more effect of absorbing such minute irregularities to make the surface smoother. However, even when the thickness of the plated layer is secured, there is formed an irregular or granular surface just like a wall surface of limestone cave. The irregular or granular surface will be reduced when the liquid temperature of plating solution is controlled so as to be above 80° C. In the case where the surface is irregular or granular, if a charging defect is caused by an extraneous substance attached to the tip of the needle electrode (sawtooth electrode) in an unexpected situation, the extraneous substance may not be fully removed even by use of a cleaner disposed in the charging apparatus, the cleaner which is a scrap sheet made of synthetic resin (such as polyethylene terephthalate) for rubbing and cleaning a needle electrode surface. Such a charging defect may possibly lead an unrecoverable state. When an appropriate plating condition is selected to form a plated layer having a thickness of 10 μm, for example, the plated layer has a very smooth surface, on a tip of which an attached extraneous substance can be easily removed by the cleaner so that a charging performance can be recovered.

The tungsten-containing nickel layer forming step can be conducted by electric plating. As the plating bath, it is possible to use a plating bath of the same sort as that used for the electroless plating. Conditions for the electric plating are the same as those for a commonly-used electric nickel plating. The tungsten-containing nickel plating through electric plating has a trend inherent to electric plating, that is, plating tends to be applied to the edge portions. It is therefore necessary to increase the layer thickness in order to make the thickness of the plating layer uniform, and the layer thickness needs to be preferably 3 μm or more.

In the case of forming the tungsten-containing nickel layer, electroless plating or electric plating is selected in accordance with the feature and cost of the respective plating methods. Further, the tungsten-containing nickel layer can be formed by not only the plating methods but also, for example, a metal deposition method or the like method.

The holding member 3 holding the needle electrode 2 is a member which extends longitudinally in one direction as the needle electrode 2 is, and of which cross section in perpendicular to the longitudinal direction has an inverted T shape. The holding member 3 is made of resin, for example. The needle electrode 2 is screwed by thread members 11 at near both ends in the longitudinal direction of the needle electrode 2 onto one lateral side of a protruded portion of the holding member 3. For charging the photoreceptor drum 19, a voltage at about 5 kV is applied for generating corona discharge during operation.

Each of the cleaning members 4*a* and 4*b* has a plate-like shape, more specifically, a T-shaped configuration when projected on a plane, and is made of an elastic body of a metal material or a polymeric material with a thickness t of from 20 to 40 μm. In the case where the thickness t is less than 20 μm, the member is easily deformed upon abutting against the needle electrode 2, but a reaction force accompanied by the deformation, i.e., the pressing force to the needle electrode 2, is small, with the result that contaminants deposited on the needle electrode 2 cannot be removed sufficiently. In the case where the thickness t exceeds 40 μm, the contaminants deposited on the needle electrode 2 can be removed sufficiently, but higher stiffness excessively increases the pressing force to the needle electrode 2, with the result that the tip of the protrusion 10 of the needle electrode 2 may possibly be fractured by the deformation. As a result, in the case where the thickness t is out of the range of 20 to 40 μm, image unevenness etc. due to the charging defect may possibly be caused. As the metal material constituting the cleaner members 4*a* and 4*b*, phosphor bronze, ordinary steel, stainless steel, etc. can be used. Among them, stainless steel is preferred from a viewpoint of the duration life based on anti-oxidation property while considering that the cleaner members 4*a* and 4*b* are used in the atmosphere of ozone generated by corona discharge. Typical examples of the stainless steel include, for example, austenitic stainless steel, i.e. SUS304 and ferritic stainless steel, i.e. SUS430, which are defined by Japanese Industrial Standard (JIS) G4305. It is however possible to use other kinds of stainless steel without restricting to the above materials.

The hardness of the cleaner members 4*a* and 4*b* is preferably 115 or more by Rockwell hardness M scale according to American Society for Testing and Materials (ASTM) Standards D785. In the case where the Rockwell hardness is less than 115, the material is excessively soft and therefore, the cleaner members 4*a* and 4*b* are deformed excessively than required when abutting on and frictionally rubbing the needle electrode 2, failing to obtain the cleaning effect. Since no particular problem occurs in view of the function in the case where the hardness of the cleaner members 4*a* and 4*b* is high, it is not necessary to define the upper limit. However, since the upper limit value in the Rockwell hardness M scale is 130, the upper limit, if defined, is 130.

The lateral size w of the longitudinal rod portion of the T-shape of the cleaner members 4*a* and 4*b*, which is a portion abutting against the needle electrode 2, that is to say, the size w of the cleaner members 4*a* and 4*b* in the direction vertical to the moving direction of the cleaner members 4*a* and 4*b* and in the direction vertical to the extending direction of the protrusion 10, is preferably 3.5 mm or more. In the case where the lateral size w is less than 3.5 mm, the value per unit area of a force generated upon deformation when pressed by the needle electrode 2 is large, and it therefore becomes easier to cause fatigue fracture due to the repetitive deformation, resulting in a decrease in length of the duration life. The value per unit area of the force described above can be decreased to extend the duration life against the repetitive deformation by making the lateral size w to 3.5 mm or more. However, the excessively increased width makes the stiffness too high and the size of the device too large, and it is therefore preferable to set the upper limit to about 10 mm.

The cleaner members 4*a* and 4*b* and the needle electrode 2 are preferably arranged such that an intrusion amount of the protrusion 10 of the needle electrode 2 to the cleaner members 4*a* and 4*b* is from 0.2 to 0.8 mm. The intrusion amount d means an overlap length between the cleaner members 4*a* and 4*b* and the protrusion 10 in the extending direction of the protrusion 10 in a state where the cleaner members 4*a* and 4*b* and the protrusion 10 are projected upon a virtual plane perpendicular to a moving direction of the cleaning members 4*a* and 4*b* relatively to the needle electrode 2. In the case where the intrusion amount d is less than 0.2 mm, a reaction force accompanied by the deformation, i.e., the pressing force to the needle electrode 2, is small, with the result that containments deposited on the needle electrode 2 cannot be removed sufficiently. In the case where the intrusion amount d exceeds 0.8 mm, the contaminants deposited on the needle electrode 2 can be removed sufficiently, but the reaction force accompanied by the deformation (i.e. the pressing force to the needle electrode 2) is too large, with the result that the tip of the protrusion 10 of the needle electrode 2 may possibly be fractured by the deformation. As a result, in the case where the intrusion amount d is out of the range from 0.2 to 0.8 mm, image unevenness etc. due to the charging defect may possibly be caused.

The support member 5 is a member having an inverted L-shaped configuration for supporting the cleaner members 4*a* and 4*b*. To a beam portion of the support member 5 is attached arm portions of the cleaner members 4*a* and 4*b* in the T-shaped configuration. The two cleaner members 4*a* and 4*b* are disposed so as to have a predetermined gap L3 with respect to the direction moving relatively to the needle electrode 2. The gap L3 is selected so as to have a distance such that when one cleaner member 4*a* is deformed upon abutting against the needle electrode 2, the other cleaner member 4*b* is not in contact with the deformed cleaner member 4*a*, and this is adjustable by the thickness of the beam portion of the support member 5 to which the cleaner members 4*a* and 4*b* are attached. Since a deformation state of the cleaner members 4*a* and 4*b* changes depending on the material thereof, the gap L3 is preferably determined by a previous testing of the deformation state of the material. In the case where each of the cleaner members 4*a* and 4*b* is made, for example, of stainless steel at a thickness t=30 μm, the gap L3 is preferably 2 mm. While one cleaner member 4*a* frictionally rubs the needle electrode 2, the gap L3 provided between the two cleaner members 4*a* and 4*b* helps to enable the pressing force to be maintained in a preferred range without hindrance in the deformation due to the other cleaner member 4*b*. As a result, the needle electrode 2 can be cleaned sufficiently with no deformation injury caused on the top end thereof.

The shield case 7 is made of, for example, stainless steel. The shield case 7 is a container-like member of which outer shape is a rectangular parallelepiped with an inner space and which has an opening in one surface facing a photoreceptor drum (not shown). Further, the shield case 7 extends longitudinally in the same direction as the extending direction of the needle electrode 2. A cross sectional configuration of the shield case 7 in a direction perpendicular to a longitudinal direction thereof is substantially U-shaped. Further, a holding member 3 is attached to a bottom 15 of the shield case 7. Moreover, an end of a columnar portion of the support member 5 is inserted slidably into a groove 14 which is formed by an inner lateral surface 13 of the shield case 7 and the holding member 3.

The columnar portion of the support member 5 has a through hole 12 therein, which extends in parallel with the extending direction of the needle electrode 2 and through which the moving member 6 is inserted. Since the moving member 6 is fixed to the support member 5 at a portion where the moving member 6 is inserted through the through hole 12, traction of the moving member 6 in the extending direction of the needle electrode 2 makes the support member 5 move slidably with respect to the groove 14 so that the support member 5 is guided by the groove portion 14 to be thereby allowed to move in the extending direction of the needle electrode 2. That is to say, the cleaner members 4*a* and 4*b* supported by the support member 5 can be made to abut on and frictionally rub the needle electrode 2.

The moving member 6 is a thread-like or wire-like member. The moving member 6 extends from a hole or gap formed in the shield case 7 to outside of the shield case 7 so that an end of the moving member 6 is suspended by way of an outer surface of the shield case 7 or by way of pulleys 16*a* and 16*b* disposed on a machine body of copying machine. The pulleys 16*a* and 16*b* and the end of the moving member 6 are not shown in FIG. 1. The end of the moving member 6 preferably extends as far as the outside of the machine body of the image forming apparatus. This enables to clean the needle electrode 2 without detaching the charging apparatus 1 from the image forming apparatus or without opening the image forming apparatus.

When cleaning is conducted by making the cleaner members 4*a* and 4*b* abut on the needle electrode 2 by means of traction of the moving member 6, the pressing force of the cleaner members 4*a* and 4*b* against the needle electrode 2 is adjusted preferably to 10 to 30 gf. In the case where the pressing force is less than 10 gf, contaminants such as toner or paper dust deposited on the needle electrode 2 can not possibly be removed sufficiently and, on the other hand, in the case where the pressing force exceeds 30 gf, the top end of the protrusion 10 of the needle electrode 2 may possibly be fractured by deformation.

The pressing force of the cleaner members 4*a* and 4*b* against the needle electrode 2 can be adjusted, for example, as described below. The force loaded on the cleaner member 4*a* or 4*b* is measured in a state where a weight is suspended from one end of the moving member 6. Measurement is conducted, for example, by connecting a spring balance to the cleaner member 4*a* or 4*b*. Then, by selecting a weight to provide a force of 10 to 30 gf loaded on the cleaner member 4*a* or 4*b* and suspending the pre-selected weight to the end of the moving member 6 upon cleaning the needle electrode 2, cleaning can be conducted under a predetermined pressing force. Further, an electric motor of which a rotational torque has been adjusted may be connected to the end of the moving member 6 so that a predetermined pressing force can be loaded.

The platy grid 8 is located between the needle electrode 2 and the photoreceptor drum (not shown). By applying the voltage to the platy grid 8, fluctuation in the charged state on the surface of the photoreceptor drum (not shown) is adjusted to make the charging potential uniform. The platy grid 8 contains a metal material as in the case of the needle electrode 2. Further, the platy grid 8 can be manufactured in the same manner as that for the needle electrode 2 except that masking and etching are performed in the chemical polishing step so that the platy grid 8 is formed into a porous structure. Further, the same nickel plating, nickel tungsten-containing nickel plating, etc. can be applied to the platy grid 8 in the same manner as in the case of the needle electrode 2.

According to the charging apparatus 1, the application of the voltage to the needle electrode 2 causes corona discharge whereby the surface of the photoreceptor drum (not shown) is charged, and the application of a predetermined grid voltage to the grid electrode makes the charged state on the surface of the photoreceptor drum uniform, with the result that the surface of the photoreceptor drum (not shown) can be charged up to a predetermined potential and polarity. Further, by the traction of the moving member 6, the support member 5 and, correspondingly, the cleaner members 4*a* and 4*b* which abut on the needle electrode 2, move so that contaminants such as toner deposited on the needle electrode 2 are removed efficiently and reliably.

Figure 3:
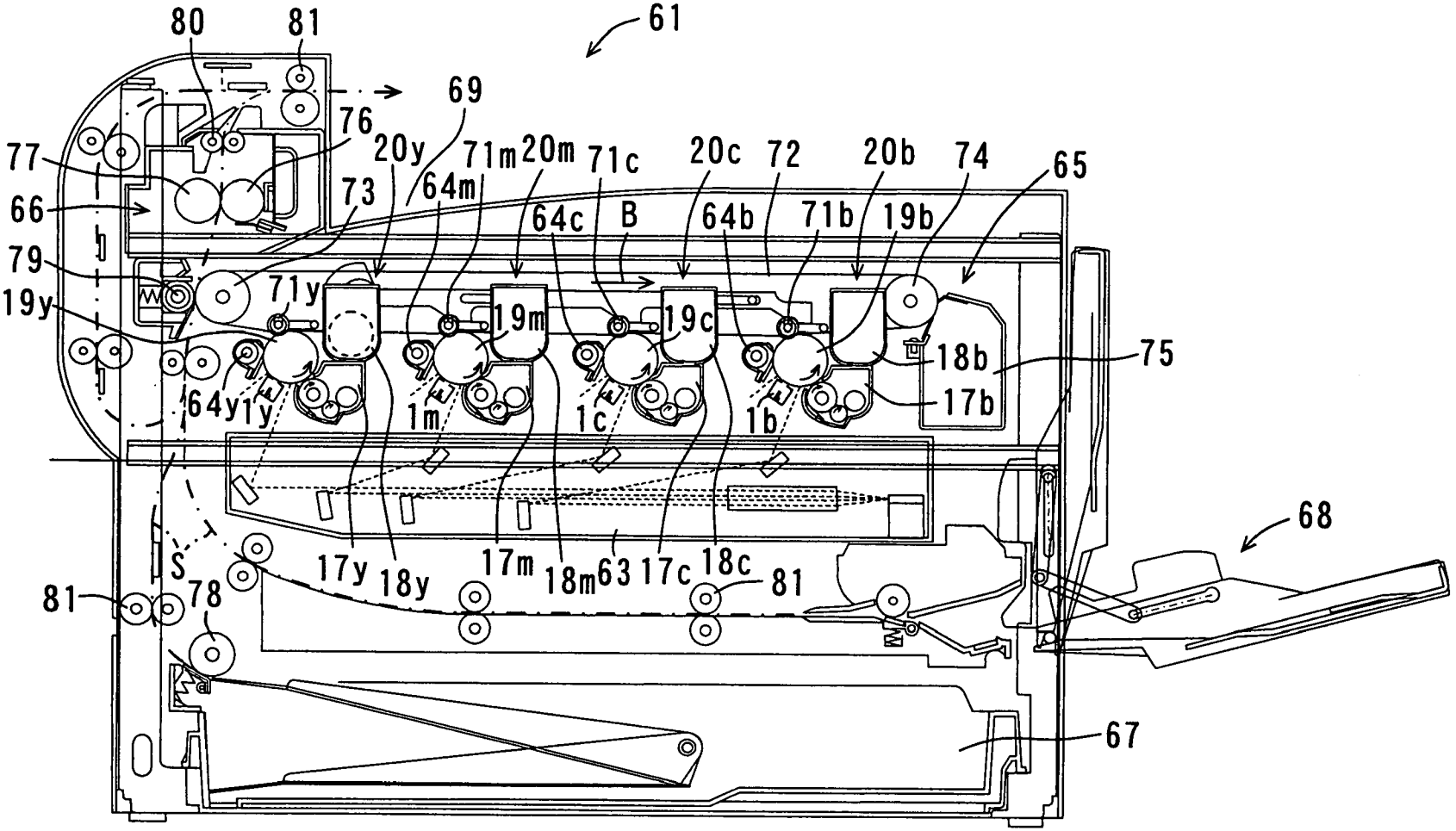
FIG. 3 is a sectional view schematically showing a configuration of an image forming apparatus according to another embodiment of the invention.

FIG. 3 is a sectional view schematically showing a configuration of an image forming apparatus 61 according to another embodiment of the invention.

An image forming apparatus 61 is a multifunctional machine having a copying function, a printer function and a facsimile function together, and according to image information being conveyed to the image forming apparatus 61, a full-color or monochrome image is formed on a recording medium such as a recording paper. That is, the image forming apparatus 61 has three types of printing modes, i.e., a copier mode (copying mode), a printer mode and a FAX mode, and the printing mode is selected by a control portion (not shown) depending on, for example, the operation input from an operation portion (not shown) and reception of the printing job from an external host apparatus such as a personal computer.

The image forming apparatus 61 comprises a photoreceptor drum 19, a charging apparatus 1, an exposure unit 63, a developing apparatus 20, a cleaning unit 64, a transfer unit 65, a fixing unit 66, a sheet conveying channel S, an automatic paper feed tray 67, a manual paper feed tray 68, and a paper discharge station 69. That is to say, the image forming apparatus 61 has a feature of including the charging apparatus 1 of the invention.

The image forming apparatus 61 is a full-color printer, and thus adapted for image information in accordance with a cooler image formed by using colors of black (b), cyan (c), magenta (m), and yellow (y). Accordingly, for the respective colors, there are provided four sets of the photoreceptor drums 19, the charging apparatuses 1, the developing apparatuses 20, the cleaning units 64, and the transfer rollers 71 provided in the transfer units 65. The four sets of respective units provided for the respective colors are distinguished herein by giving alphabets indicating the respective colors to the end of the reference numeral, and in the case where the sets are collectively referred to, only the reference numeral is shown. Note that the exposure unit 63 divaricates the image information therein into light of respective color information for b, c, m, and y, and emits the light of respective color information to thereby expose the photoreceptor drum 19 on which an electrostatic latent image of respective colors is to be formed. As the exposure unit 63, there is thus provided one laser scanning unit having, for example, a laser emitting portion and a plurality of reflecting mirrors.

The charging apparatus 1, the developing apparatus 20, the transfer roller 71, and the cleaning unit 64 are disposed in this order around the photoreceptor drum 19. The charging apparatus 1 is disposed below the developing apparatus 20 and the cleaning unit 64 in a vertical direction thereof. That is to say, the developing-apparatus 20 and the cleaning unit 64 are disposed above the charging apparatus 1 in a vertical direction thereof. The exposure unit 63 is disposed so that the light of respective color information emitted from the exposure unit 63 passes between the charging apparatus 1 and the developing apparatus 20 to irradiate a surface of the photoreceptor drum 19 therewith.

The photoreceptor 19 is rotatably supported around an axis thereof by a driving mechanism (not shown), and includes a conductive substrate (not shown) in cylindrical, circular columnar shape or in the form of thin film sheet, preferably, a cylindrical conductive substrate, and a photosensitive layer formed on the surface of the conductive substrate.

As the conductive material for the material of the conductive substrate, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film obtained by forming a conductive layer containing one or more of aluminum, aluminum alloy, tin oxide, gold, indium oxide, etc. on a film-like substrate such as of synthetic resin film, metal film, and paper; and a resin composition containing conductive particles and/or conductive polymers. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. Provision of the undercoat layer can provide an advantage of covering the injury and irregularities present on the surface of the conductive substrate to smooth the surface of the photosensitive layer, preventing degradation of the chargeability of the photosensitive layer during repetitive use, and improving the charging property of the photosensitive layer under a low temperature and/or low humidity circumstance.

The charge generating layer contains as a main ingredient a charge generating substance that generates charges under irradiation of light, and optionally contains known binder resin, plasticizer, sensitizer, etc. As the charge generating substance, those used customarily in the relevant field can be used including, for example, perylene pigments such as perylene imide and perylenic acid anhydride; polynuclear quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, strylstylbene skeleton, triphenylamine skeleton, dibenzothiophene skeleton, oxadiazole skeleton, fluorenone skeleton, bisstylbene skeleton, distyryloxadiazole skeleton, or distyryl carbazole skeleton. Among them, non-metal phthalocyanine pigments, oxotitanyl phthalocyanine pigments, bisazo pigments containing fluorene rings and/or fluorenone rings, bisazo pigments containing aromatic amines, and tris azo pigments have high charge generation ability and are suitable for obtaining a light sensitive layer at high sensitivity. The charge generating substance can be used alone or two or more of the materials can be used in combination. The content of the charge generating substance is, without a particular restriction, preferably from 5 to 500 parts by weight and more preferably from 10 to 200 parts by weight based on 100 parts by weight of binder resin in the charge generating layer.

Also as the binder resin for the charge generating layer, those used customarily in the relevant field can be used including, for example, melamine resin, epoxy resin, silicone resin, polyurethane, acryl resin, vinyl chloride-vinyl acetate copolymer resin, polycarbonate, phenoxy resin, polyvinyl butyral, polyallylate, polyamide, and polyester. The binder resin can be used alone or, optionally, two or more of the resins can be used in combination.

The charge generating layer can be formed by dissolving or dispersing a charge generating substance, binder resin and, optionally, a plasticizer, a sensitizer, etc. each in an appropriate amount in an appropriate organic solvent which is capable of dissolving or dispersing the ingredients described above, to thereby prepare a coating solution for charge generating layer, and then applying the coating solution for charge generating layer to the surface of a conductive substrate, followed by drying. The thickness of the charge generating layer obtained in this way is, without a particular restriction, preferably from 0.05 to 5 μm and more preferably from 0.1 to 2.5 μm.

The charge transporting layer stacked over the charge generating layer contains as essential ingredients a charge transporting substance having an ability of receiving and transporting charges generated from the charge generating substance, and binder resin for the charge transporting layer, and optionally contains known antioxidant, plasticizer, sensitizer, lubricant, etc. As the charge transporting substance, those used customarily in the relevant field can be used including, for example, electron donating materials such as poly-N-vinyl carbazole and derivatives thereof, poly-γ-carbazolyl ethyl glutamate and derivatives thereof, pyrene-formaldehyde condensation product and derivatives thereof, polyvinylpyrene, polyvinyl phenanthrene, oxazole derivatives, oxadiazole derivatives, imidazole derivatives, 9-(p-diethylaminostyryl)anthracene, 1,1-bis(4-dibenzylaminophenyl) propane, styrylanthracene, styrylpyrazoline, pyrazoline derivatives, phenyl hydrazones, hydrazone derivatives, triphenylamine compounds, tetraphenyldiamine compounds, triphenylmethane compounds, stylbene compounds, and azine compound having 3-methyl-2-benzothiazoline ring; and electron accepting materials such as fluorenone derivatives, dibenzothiophene derivatives, indenothiopnene derivatives, phenanthrenequinone derivatives, indenopyridine derivatives, thioquisantone derivatives, benzo[c]cinnoline derivatives, phenazine oxide derivatives, tetracyanoethylene, tetracyanoquinodimethane, promanyl, chloranyl, and benzoquinone. The charge transporting substance can be used alone or two or more of the materials can be used in combination. The content of the charge transporting substance is, without a particular restriction, preferably from 10 to 300 parts by weight and more preferably from 30 to 150 parts by weight based on 100 parts by weight of the binder resin in the charge transporting substance.

As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resins thereof. Among them, in view of the film forming property, and the wear resistance, electrical characteristics etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resin can be used alone or two or more of the resins can be used in combination.

The charge transporting layer preferably contains an antioxidant together with the charge transfer material and the binder resin for charge transporting layer. Also for the antioxidant, those used customarily in the relevant field can be used including, for example, Vitamin E, hydroquinone, hindered amine, hindered phenol, paraphenylene diamine, arylalkane and derivatives thereof, organic sulfur compounds, organic phosphorus compounds, etc. The antioxidant can be used alone-or two or more of the antioxidants can be used in combination. The content of the antioxidant is, without a particular restriction, from 0.01 to 10% by weight and preferably from 0.05 to 5% by weight based on the total amount of the ingredients constituting the charge transporting layer.

The charge transporting layer can be formed by dissolving or dispersing a charge transporting substance, binder resin and, optionally, an antioxidant, a plasticizer, a sensitizer, etc. each in an appropriate amount in an appropriate organic solvent which is capable of dissolving or dispersing the ingredients described above, to thereby prepare a coating solution for charge transporting layer, and applying the coating solution for charge transporting layer to the surface of a charge generating layer followed by drying. The thickness of the charge transporting layer obtained in this way is, without a particular restriction, preferably from 10 to 50 μm and more preferably from 15 to 40 μm.

Note that it is also possible to form a photosensitive layer in which a charge generating substance and a charge transporting substance are present in one layer. In this case, the kind and content of the charge generating substance and the charge transporting substance, the kind of the binder resin, and other additives may be the same as those in the case of forming separately the charge generating layer and the charge transporting layer.

In the embodiment, as described above, there is used a photoreceptor drum in which an organic photosensitive layer using the charge generating substance and the charge transporting substance is formed. It is, however, also possible to use, instead of the above photoreceptor drum, a photoreceptor drum in which an inorganic photosensitive layer using silicon or the like is formed.

The charging apparatus 1 being used is the charging apparatus 1 shown in FIG. 1 and FIG. 2. The charging apparatus 1 is disposed along a longitudinal direction of the photoreceptor drum 19 so that the charging apparatus 1 faces the photoreceptor drum 19. The exposure unit 63 exposes, according to image information of respective colors, the surface of the photoreceptor drum 19 which has been charged by the charging apparatus 1 to a uniform potential, to thereby form an electrostatic latent image on the surface of the photoreceptor drum 19.

The developing apparatus 20 comprises a developer tank 17 and a toner hopper 18. The developer tank 17 is disposed so as to face the surface of the photoreceptor drum 19, and supplies toner to the electrostatic latent image formed on the surface of the photoreceptor drum 19, to develop the image so that a visible image, i.e., a toner image is formed. Inside the developer tank 17, a developing roller is rotatably disposed at an opening portion of the developer tank, more specifically at a position opposed to the photoreceptor drum 19. The developing roller is a roller-shaped member for supplying the toner to the electrostatic latent image on the photoreceptor drum 19. Moreover, together with the developing roller, a supply roller and a stirring roller are provided. The supply roller is a roller-shaped member which is opposed to the developing roller and disposed rotatably, and used to supply the toner to the periphery of the developing roller. The stirring roller is a roller-shaped member which is opposed to the supply roller and disposed rotatably, and used to supply to the periphery of the supply roller toner being newly supplied from the toner hopper 18 into the developer tank 17. The toner hopper 18 is provided so that a toner refill port (not shown) disposed at a lower portion in a vertical direction of the toner hopper 18 and a toner receiving port (not shown) disposed at an upper portion in a vertical direction of the developer tank 17 are communicated with each other. The toner hopper 18 refills the developer tank 17 with toner according to a condition of toner consumption in the developer tank 17.

As the toner being used in this case, any toner used customarily in the relevant field can be used. For example, toner containing binder resin, a colorant, a charge control agent, a release agent, etc. can be used.

As the binder resin, those used customarily in the relevant field can be used including, for example, a styrene-based copolymer, polyvinyl chloride, phenolic resin, anaturally modified phenolic resin, naturally modified maleic resin, acrylic resin, methacrylic resin, polyvinyl acetate, silicone resin, polyester, polyurethane, polyamide resin, furan resin, epoxy resin, xylene resin, polyvinyl butyral, terpene resin, coumarone-indene resin, and petroleum resin.

As the colorant, those used customarily in the relevant field can be used including, for example, a colorant for yellow toner, a colorant for magenta toner, a colorant for cyan toner, and a colorant for black toner. Examples of the colorant for yellow toner include azo pigments such as CI pigment yellow 1, CI pigment yellow 5, CI pigment yellow 12, CI pigment yellow 15, and CI pigment yellow 17; inorganic pigments such as yellow iron oxide and yellow ochre; nitro dyes such as CI acid yellow 1; and solvent dyes such as CI solvent yellow 2, CI solvent yellow 6, CI solvent yellow 14, CI solvent yellow 15, CI solvent yellow 19, and CI solvent yellow 21, which are classified according to the color index. Examples of the colorant for magenta toner include CI pigment red 49, CI pigment red 57, CI pigment red 81, CI pigment red 122, CI solvent red 19, CI solvent red 49, CI solvent red 52, CI basic red 10, and CI disperse red 15, which are classified according to the color index. Examples of the colorant for cyan toner include CI pigment blue 15, CI pigment blue 16, CI solvent blue 55, CI solvent blue 70, CI direct blue 25, and CI direct blue 86, which are classified according to the color index. Examples of the colorant for black toner include carbon blacks such as channel black, roller black, disc black, gas furnace black, oil furnace black, thermal black, and acetylene black. Among the various carbon blacks, a suitable carbon black may be appropriately selected according to an intended design characteristic of toner.

The colorant can be used alone or two or more of the materials can be used in combination. Further, two or more materials of the same color series can be used, and one or two or more materials of different color series can be used.

A usage of the colorant is, without a particular restriction, preferably 5 to 20 parts by weight based on 100 parts by weight of the binder resin. By using the colorant of which amount is in the above range, various properties of toner are not deteriorated, and it is thus possible to form an image of high density and very high quality.

As the charge control agent, it is possible to use those for positive charge control and for negative charge control, which are used customarily in the relevant field. Examples of the charge control agent for positive charge control include basic dye, quaternary ammonium, aminopyrine, a pyrimidine compound, a polynuclear polyamino compound, aminosilane, and a nigrosine dye. Examples of the charge control agent for negative charge control include solvent dyes such as oil black and spilon black; a metal-contained azo compound; metal salt naphthenate; metal salt salicylate; a fatty acid soap; and a resin acid soap. The charge control agent can be used alone or two or more of the materials can be used in combination. A usage of the charge control agent can be, without a particular restriction, appropriately selected from a wide range and is preferably 0.5 to 3 parts by weight based on 100 parts by weight of the binder resin.

As the release agent, those used customarily in the relevant field can be used including, for example, petroleum wax such as paraffin wax, a derivative thereof, microcrystalline wax, and a derivative thereof; hydrocarbon synthetic wax such as Fischer-Tropsch wax, a derivative thereof, polyolefin wax, a derivative thereof, low-molecular-weight polypropylene wax, a derivative thereof, low-molecular-weight polyethylene wax, and a derivative thereof; vegetable-based wax such as carnauba wax, a derivative thereof, rice wax, a derivative thereof, candelilla wax, a derivative thereof, and haze wax; animal-based wax such as bees wax and whale wax; oil and fat-based synthetic wax such as fatty acid amide and phenolic fatty acid ester; long-chain carboxylic acid, and derivative thereof; and long-chain alcohol and a derivative thereof. Note that the derivatives include an oxide, a block copolymer of vinyl-based monomer and wax, and a graft modification. A usage of the wax can be, without a particular restriction, appropriately selected from a wide range and is preferably 0.2 to 20 parts by weight based on 100 parts by weight of the binder resin.

Furthermore, a fluidity improver may be contained as an external additive. The fluidity improver exerts an effect thereof when attached to, for example, a surface of toner. As the fluidity improver, those used customarily in the relevant filed can be used including, for example, silica, titanium oxide, silicon carbide, and aluminum oxide. The fluidity improver may have a surface thereof treated with a hydrophobic process by use of, for example, polyorganosiloxane having a trimethylsilyl group. The hydrophobic process is preferably applied to silica or the like material. The hydrophobized fluidity improver, particularly hydrophobized silica, is generally attached to an electrode etc. of a charging apparatus, and often decreases a charging ability of the charging apparatus for a photoreceptor drum, resulting in a charging defect. By contrast, when the charging apparatus 1 of the invention is used, even an image formation using toner containing hydrophobized silica lead no charging defect and there are thus caused no defects in images. The fluidity improver can be used alone or two or more of the materials can be used in combination. A usage of the fluidity improve is, without a particular restriction, preferably 0.1 to 3.0 parts by weight based on 100 parts by weight of the toner particles.

After the toner image is transferred onto the recording medium by the transfer unit 65, the cleaning unit 64 cleans the surface of the photoreceptor drum 19 by removing the toner remaining on the surface of the photoreceptor drum 19. For the cleaning unit 64, a plate-shaped member such as a cleaning blade is used. In the image forming apparatus according to the invention, an organic photoreceptor drum is used predominantly for the photoreceptor drum 19, and since the surface of the organic photoreceptor drum mainly contains a resin ingredient, the surface tends to be degraded by the chemical action of ozone generated by the corona discharge by the charging apparatus. However, the degraded surface portion is worn under the frictional rubbing effect brought by the cleaning unit 64, and is removed reliably although gradually. Accordingly, the problem of the degradation of the surface by the ozone or the like can be actually overcome, and the potential of the surface being charged through the charging operation can be maintained stably for a long time.

The transfer unit 65 is located above the photoreceptor drum 19, and comprises a transfer belt 72, a transfer belt driving roller 73, a transfer belt driven roller 74, a transfer roller 71 (b, c, m, and y), and a transfer belt cleaning unit 75. The transfer belt 72 is tightly stretched over the transfer belt driving roller 73, the transfer belt driven roller 74, and the transfer roller 71. Rotation of the transfer belt driving roller 73 being driven works on the transfer belt 72 so as to be driven to rotate in an arrow B direction.

The transfer belt 72 driven to rotate in the arrow B direction is an intermediate transfer belt, and disposed in contact with the respective photoreceptor drums 19. When the transfer belt 72 passes by the photoreceptor drum 19 in a state of being in contact therewith, there is applied a transfer bias of which polarity is opposite to the polarity of the charged toner on the surface of the photoreceptor drum 19, from the transfer roller 71 which is disposed opposite to the photoreceptor drum 19 across the transfer belt 72, with the result that the toner image formed on the surface of the photoreceptor drum 19 is transferred onto the transfer belt 72. In the case of full-color image, toner images of respective colors formed at the respective photoreceptor drums 19 are sequentially stacked on the transfer belt 72 so that a full-color image is formed.

The transfer belt cleaning unit 75 is disposed so as to be opposite to the transfer belt driven roller 74 and in contact with an outer circumferential surface of the transfer belt 72 tightly stretched over the transfer belt driven roller 74. Since the toner attached to the transfer belt 72 through contact with the photoreceptor drum 19 may cause a contamination on a backside of the recording medium, the transfer belt cleaning unit 75 removes and collects the toner on the surface of the transfer belt 72.

The recording mediums, e.g. recording paper, on which the toner images are to be recorded, are stored in the automatic paper feed tray 67. In the image forming apparatus 61 of the invention, the automatic paper feed tray 67 is disposed in a lower portion of the apparatus. The recording paper stored in the automatic paper feed tray 67 is taken out of the automatic paper feed tray 67 sheet by sheet to be thereafter fed to the sheet conveying channel S by the pickup rollers 78. The recording paper fed to the sheet conveying channel S is conveyed by a plurality of conveying rollers 81 disposed at various positions of the sheet conveying channel S, and in synchronization with a position of the formed image which has been transferred on the transfer belt 72 at the transfer unit 65, the recording paper is fed to a nip portion between the transfer belt driving roller 73 and a recording paper transfer roller 79 which is disposed so as to face the transfer belt driving roller 73 and be pressed on the transfer belt driving roller 73. As a result of application of the transfer bias from the recording paper transfer roller 79 to the recording paper passing through the above-described nip portion, the toner image is transferred from the transfer belt 72 onto the recording paper. Note that the feeding of the recording paper is not restricted to the feeding from the automatic paper feed tray 67 but may be from the manual paper feed tray 68 through another sheet conveying channel S.

The fixing unit 66 is disposed downstream of the transfer unit 65 in a conveying direction of recording paper, and comprises a heating roller 76 and a pressure roller 77, a heat source of the heating roller 76, a sensor detecting a temperature of the heating roller 76, and a control portion for controlling the heat source to operate so that the heating roller 76 attains a predetermined temperature. The heating roller 76 and the pressure roller 77 are disposed so that the recording paper nipped under pressure between the heating roller 76 and pressure roller 77 in a mutually pressed state can be conveyed. In the fixing unit 66, when the recording paper passes through the nip portion formed between the heating roller 76 and the pressure roller 77, the toner image is heated and pressurized to be fixed on the recording paper so that a solid recording image is formed.

The recording paper on which the toner image has been fixed in the fixing unit 66, is discharged to the paper discharge station 69 by a paper discharge roller 80 and a conveying roller 81 which are disposed at an exit side of the fixing unit 66.

Hereinbelow, an image forming operation in the image forming apparatus 61 will be briefly described. In an image forming section, the surface of the photoreceptor drum 19 is charged to a uniform potential by the charging apparatus 1, and according to the image information, the exposure unit 63 exposes the image to form the electrostatic latent image which is then developed by the developing apparatus 20 to form the toner image. The toner images of respective colors formed on the surfaces of the respective photoreceptor drums 19 are sequentially stacked on the transfer belt 72 so that the full-color image is formed.

The toner image transferred on the toner belt 72 is transferred onto the recording paper which has been picked up from the automatic paper feed tray 67 by the pickup roller 78 and conveyed in the sheet conveying channel S to the nip portion between the transfer belt driving roller 73 and the recording paper transfer roller 79. The recording paper on which the toner image has been transferred, is conveyed to the fixing unit 66 where the toner image is then treated with a fixing process into the solid recording image, and discharged to the paper discharge station 69 where a series of image forming operation comes to the end.

The image forming apparatus 61 is provided with the charging apparatus 1. This makes it possible to prevent the charging defects of the photoreceptor drum 19, with the result that images of high quality and high grade can be formed over a long period of time.

EXAMPLE

The invention will be described specifically with reference to examples.

Example 1

To a plate metal formed of stainless steel (SUS304) (sized 20 mm×310 mm×0.1 mm thickness) were applied masking and etching to prepare a needle electrode substrate. The etching was conducted by spraying an aqueous 30 wt % solution of ferric chloride to the plate metal of stainless steel at a liquid temperature of 90° C. for 2 hours. After the etching, the needle electrode substrate was taken out of the etching solution, and water washing and cleaning with pure water were conducted to manufacture a needle electrode substrate.

An Ni plating layer of 0.5 μm thickness was formed by electric plating on the surface of the needle electrode substrate obtained as described above. And then, the needle electrode substrate having the Ni plating layer formed thereon was dipped into a tungsten-containing nickel solution (temperature: 90° C.) for 60 min to manufacture a needle electrode, on a surface of which a tungsten-containing nickel plated layer of 3 μm thickness was formed. The tungsten-containing nickel plated layer contained 94% by weight nickel, 5% by weight tungsten, and 1% by weight boron. After the plating, the needle electrode was taken out of the plating bath, and water washing and cleaning with pure water were conducted, followed by drying. A surface of the plated layer was observed by electron microscopy, and it was confirmed that the surface was very smooth.

The needle electrode (sawtooth electrode) replaced a needle electrode of a charging apparatus in a commercially available image forming apparatus (trade name of products: AR625, manufactured by Sharp Corp.) to manufacture an image forming apparatus including the charging apparatus of the invention. The following test was conducted by use of the needle electrode, the charging apparatus and the image forming apparatus.

[Discharging Test]

As a test under harsh conditions, an aging test with no paper passage under a low humidity condition (10% or lower) was conducted. Since AR625 is a 70 sheet machine, 71 hours corresponds to the number of copies (300K life). In the test, the potential of the charged surface of the photoreceptor drum was set to −630 V at the initial state.

[Detection of Nitrogen Oxide and Rust]

The rust and nitrogen oxides were detected by microscopic observation on the needle electrode after discharging.

As a result, no deposition of rust etc. was found on the plated needle electrode according to the invention whereas a deposition of rust etc. is found on a needle electrode left in the state of the stainless material as it was.

Also after printing 300000 sheets in an actual copying test, white streaks or black streaks were observed in half-tone images in the case where the cleaning is not performed on the needle electrode left in the state of the stainless material as it was whereas the quality of half-tone images was uniform and no unevenness occurred in the plated needle electrode of the invention.

[Extraneous Substance Attachment Test]

Inside an about 1 $m^3$ volume-chamber for acceleration test, hydrophobic silica was heated to 120° C. or more to contaminate an interior portion of the chamber. The charging apparatus of the invention was placed in the chamber and continuously discharged electricity for 2 hours. An extraneous substance was forcibly attached to tips of the needle electrode (sawtooth electrode) to cause a charging defect. After that, the charging apparatus of the invention was taken out of the chamber, and a rubbing cleaning was conducted by a cleaner provided in the charging apparatus. By so doing, the extraneous substance was removed from the tips of the needle electrode, resulting in recovery of favorable charging property of the charging apparatus. The charging apparatus was incorporated into a commercially available image forming apparatus (trade name of product: AR625, manufactured by Sharp Corp.), and an image was formed therewith. It was then confirmed that the apparatus was able to offer an image of favorable quality, which was evenly charged without variation.

A needle electrode (sawtooth electrode) on which a gold plated layer had been formed instead of the tungsten-containing nickel plated layer, was mounted in the charging apparatus, and in the same manner as described above, the extraneous substance (hydrophobic silica) was forcibly attached to the needle electrode. In this case, even when the cleaning was conducted, the charging property was not recovered and just an unevenly charged image was formed.

Further, it was found that, owing to the smoothness on the surface recognized as the feature of the tungsten-containing nickel plating, deposits such as dusts in air were decreased compared to the needle electrode left in the state of the stainless material as it was, and the dusts were able to be removed easily by cleaning. On the contrary, in the case where only the Ni plated layer is applied, contaminants could not be removed sufficiently by cleaning and therefore, the quality of half-tone images was not recovered uniformly after cleaning.

Note that, regarding polytetrafluoroethylene powder-containing nickel electroless plating of which cost is lower than the tungsten-containing nickel plating, an allowable temperature limit is lower than that of the tungsten-containing nickel plating, but an appropriate selection of a plating condition, e.g. application of plating having a thickness of 10 μm, enables to make the surface of the plated layer smooth. The polytetrafluoroethylene powder-containing nickel electroless plating is thus effective for securing the cleaning performance.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A charging apparatus comprising:

an electrode having a plurality of pointed protrusions, that applies a voltage to a surface of a photoreceptor drum to charge the surface; and a plate grid disposed between the electrode and the photoreceptor drum, that controls a potential of the surface of the photoreceptor drum being charged, wherein a nickel layer containing tungsten is formed on at least one of surfaces of the electrode and wherein a thickness of the nickel layer containing tungsten is 0.3 μm or more.

2. The charging apparatus of claim 1, wherein the nickel layer containing tungsten is formed by an electroless plating method.

3. An image forming apparatus comprising:

a photoreceptor drum on a surface of which an electrostatic latent image is formed;

the charging apparatus of claim 1, for charging the surface of the photoreceptor drum;

an exposure unit that irradiates the charged surface of the photoreceptor drum with signal light based on image information to thereby form the electrostatic latent image;

a developing apparatus that develops the electrostatic latent image formed on the surface of the photoreceptor drum to thereby form a toner image;

a transfer unit that transfers the toner image onto a recording material; and a fixing unit that fixes the toner image transferred on the recording material.

4. The image forming apparatus of claim 3, further comprising a cleaning unit that cleans the surface of the photoreceptor drum after the toner image has been transferred onto the recording material by the transfer unit, wherein the developing apparatus and/or the cleaning unit are/is located above the charging apparatus.

5. The image forming apparatus of claim 3, wherein the toner image is formed of toner which contains hydrophobic silica as an external additive.

6. A charging apparatus comprising:

an electrode having a plurality of pointed protrusions, that applies a voltage to a surface of a photoreceptor drum to charge the surface; and a plate grid disposed between the electrode and the photoreceptor drum, that controls a potential of the surface of the photoreceptor drum being charged, wherein a nickel layer containing tungsten is formed on at least one of surfaces of the electrode, wherein another nickel layer is formed between the electrode and the nickel layer containing tungsten.

7. A charging apparatus comprising:

an electrode having a plurality of pointed protrusions, that applies a voltage to a surface of a photoreceptor drum to charge the surface; and a plate grid disposed between the electrode and the photoreceptor drum, that controls a potential of the surface of the photoreceptor drum being charged, wherein a nickel layer containing tungsten is formed on at least one of surfaces of the electrode, wherein the nickel layer containing tungsten contains phosphorus together with tungsten.

* * * * *